US006962534B2

(12) United States Patent
Richter et al.

(10) Patent No.: US 6,962,534 B2
(45) Date of Patent: Nov. 8, 2005

(54) INTERACTIVE WINTER RECREATION FACILITY

(75) Inventors: Rico Richter, München (DE); Christian Pfluegler, Miesbach (DE)

(73) Assignee: Hans-Rodolf Kaelin, Rüttenen (CH)

( * ) Notice: Subject to any disclaimer, the term of this patent is extended or adjusted under 35 U.S.C. 154(b) by 0 days.

(21) Appl. No.: 10/648,898

(22) Filed: Aug. 27, 2003

(65) Prior Publication Data

US 2005/0051687 A1 Mar. 10, 2005

Related U.S. Application Data

(60) Provisional application No. 60/406,614, filed on Aug. 28, 2002.

(51) Int. Cl.[7] ..... A63C 19/10
(52) U.S. Cl. ..... 472/90
(58) Field of Search ..... 472/88–92, 94

(56) References Cited

U.S. PATENT DOCUMENTS 3,250,530 A * 5/1966 Dean et al. ..... 472/90
3,801,093 A * 4/1974 Jones, III ..... 472/94
4,790,531 A * 12/1988 Matsui et al. ..... 472/90
4,976,422 A * 12/1990 Shimamura ..... 472/90
5,194,048 A 3/1993 Briggs
5,327,738 A * 7/1994 Morioka et al. ..... 62/74
6,488,590 B2 * 12/2002 Katayama ..... 472/90
6,722,995 B1 * 4/2004 Albers ..... 472/90

* cited by examiner

*Primary Examiner*—Kien Nguyen
(74) *Attorney, Agent, or Firm*—Greer, Burns & Crain, Ltd.

(57) ABSTRACT

A winter recreational park is provided for amusing and entertaining one or more participants, the park being intended for location in semi-arid or desert regions. The winter park includes a plurality of interconnected housing structures adapted to safely house the participants as well as winter facilities built with artificial snow and/or ice. The housing structures are adapted to maintain inside temperatures below the freezing point, despite the normally high outside temperatures. The recreational park further includes a plurality of active devices, such as skis or ice skates, adapted for use in each of the respective winter facilities to create the desired effect on ice and/or snow.

14 Claims, 3 Drawing Sheets

INTERACTIVE WINTER RECREATION FACILITY

RELATED APPLICATION

This is a nonprovisional application based on U.S. Ser. No. 60/406,614 filed Aug. 28, 2002.

BACKGROUND OF THE INVENTION

The present invention relates generally to the field of recreation parks and more particularly to a park having winter recreational structures for safe entertainment and amusement of children, teenagers as well as adults.

Commercial play structures such as theme parks have recently become popular, which are designed to meet the recreational needs of families and adults. Conventional commercial structures are often adapted to certain themes such as water activities, old western settings, fantasylands, etc.

A typical play structure may include several play areas of different types of play and often interconnected with slides, tunnels, bridges and walking paths or the like.

Conventional play structures are often designed for outdoor use and are found in recreational parks or theme parks. For this reason, such parks are located in more temperate southerly regions where the winters are mild and snow and ice does not frequently occur even in the wintertime. In such moderate climates on the other hand many of the inhabitants have never seen snow and have never experienced winter sporting activities, such as skiing, sledding or ice skating. In such regions, even in desert areas of the south western United States or in Middle Eastern or Asian countries, a desire exists to engage in recreational activities related to winter, whereas this is largely prevented by the lack of cold winter weather.

The object of the present invention is therefore to provide a winter recreational park with interactive winter facilities adapted to activities in snow and ice, where the park can be located in very moderate, arid or even desert climates.

A very large-scale commercial water park, which incorporates interactive water play structures, is disclosed in U.S. Pat. No. 5,194,048. Participants including both children and adults have discovered the entertainment and educational benefits of such parks, apart from the pure amusement.

SUMMARY OF THE INVENTION

According to the present invention, a winter recreational park is provided for amusing and entertaining one or more participants. The park comprises a plurality of interconnected housing structures, such as domes or tunnels, each adapted to safely house the participants as well as at least one winter facility. The winter facility is based on the media of ice and/or snow and can include for example ski slopes, ski jumps, sledding runs, snowboard halfpipes, bobsled runs, ice skating rinks, curling rinks or the like. The present winter recreational park also includes a plurality of active devices adapted to the respective winter facilities to create a desired effect on the ice and/or snow media. The active devices include for example skis, snowboards, sleds, bobsleds, snowmobiles, ice skates, etc.

In a particular embodiment of the present invention, the results of use by one or more participants with a given active device is interactively coupled to the activity of one or more participants with the same or another device in either the same winter facility or another facility. For example, should one participant break a speed record on the bobsled with a bobsled device, flashing lights, sound and fireworks can be initiated and at the same time all other participants currently having bobsled tickets will receive a free run. As another example, when a monitoring system recognizes that nearly a maximum number of skis (as the active devices) are being used on a certain ski slope and at the same time the number of participants using ice skates on the ice skating rink is minimum, the participants on the ski slope can be awarded with a bonus ticket for one hour on the ice skating rink. This interactive aspect of the activity of the participants, detected by sensors on the active devices and transmitted by wireless receivers held by the participants, greatly adds to the amusement and entertainment effect of the visitors to the recreational park.

The present invention extends the recreation concept of such parks to winter activities in regions where no snow or ice exists. Not only are the winter activities, such as skiing, sledding, snowboarding, ice skating, etc. amusing for participants who have not experienced ice or snow, a considerable educational effect is achieved for those who have never confronted winter conditions.

The present winter recreational facility is based on the media of ice and snow, and employs structures such as in the form of ski slopes, ski jumps, bobsled courses, sledding slopes, snowboard areas with halfpipes and ice skating rinks.

The recreational park will normally be located on either a man-made or natural slope, such as a mountainside or hill slope. The structures, i.e. the ski slopes, skating rinks, etc. are contained in buildings with widths of up to 100 meters and lengths up to 1 kilometer.

In another embodiment, the recreational facility includes a start-off building at an elevated location on the side of a hill or mountain, where 2 or 3 ski slopes, sledding slopes, etc. diverge from a starting point in different directions down the hill in tunnel-like structures. In further embodiments, a ski jump and a bobsled run can be accessed a short distance from the start-off building.

In another particular embodiment, the covering of the slopes is constructed with at least partially transparent roofing, which largely eliminates the need for artificial lighting. Furthermore, large areas of the roof may be provided with photovoltaic cells (solar cells) to supply the electrical needs of the recreation facility. In particular, in moderate or arid climates, the solar intensity is high enough that a large portion of the energy consumption of the facility can be supplied.

In a further embodiment, the roof portion of the facility is formed in rounded shape, for example the tunnel-like area covering the ski slopes has a curved surface so as to enhance the use of solar radiation. In other words, as the sun tracks along the sky from morning to evening, it always impinges nearly perpendicular on a portion of the curved roof and the associated solar cells to achieve optimized solar energy utilization.

Alternatively, a smaller portion of the roof areas can be provided with solar cells, while the parking lot of the facility, which will include at least 5 acres, can be covered with a solar cell roof assembly for generating electricity. In some desert regions, with temperatures frequently above 40° C., it is necessary anyway to cover parked cars. This can be conveniently achieved by providing a construction open at the sides, but a roof constructed largely of solar cell panels. In this case, the roofs of the tunnel-like structures can be made of lightweight translucent materials, which preferably can also be covered with a coating to reflect UV or other high-intensity solar radiation.

DETAILED DESCRIPTION OF THE INVENTION

Figure 1:
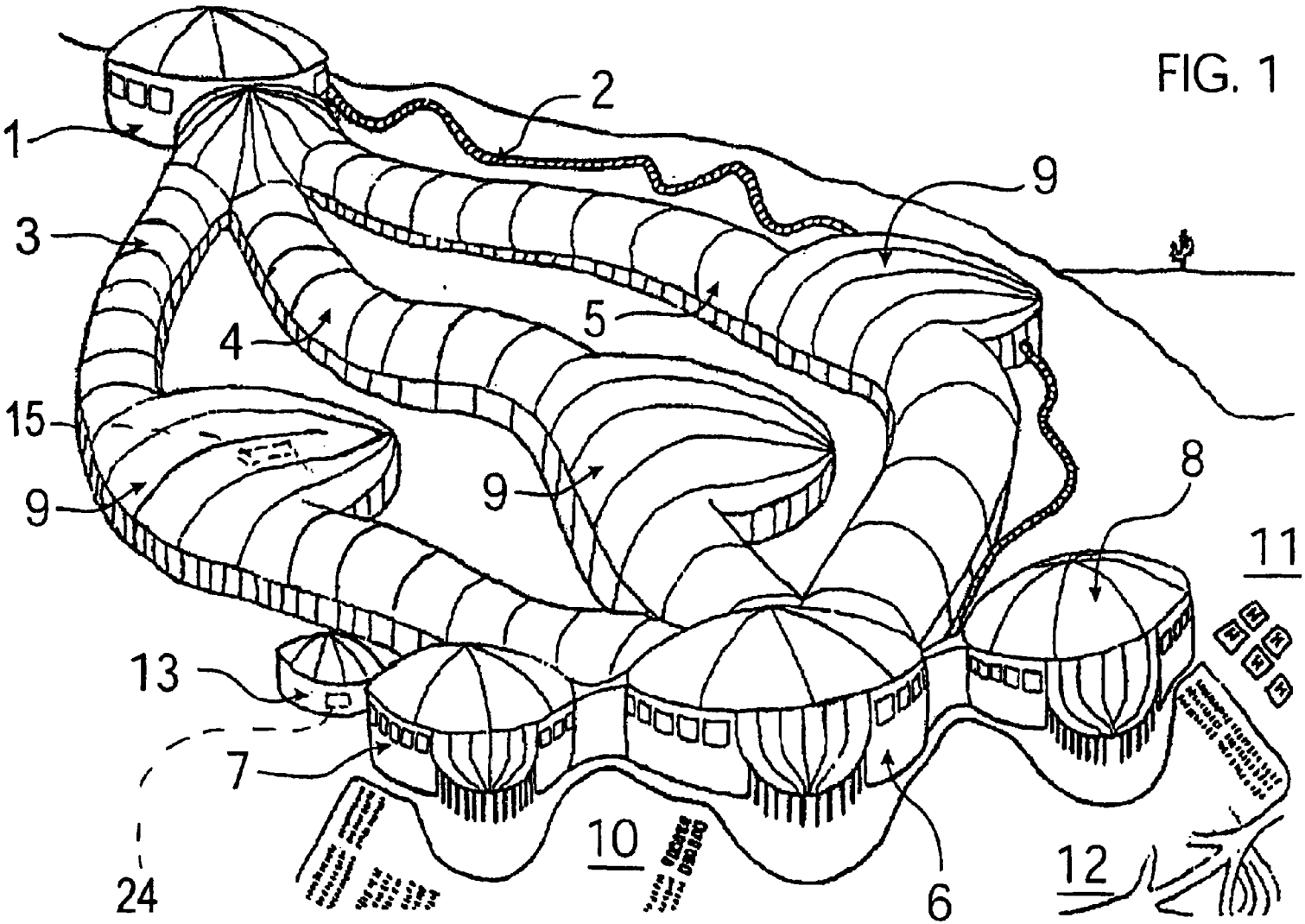
FIG. 1 is a perspective view of one preferred embodiment of the recreational facility having winter recreational structures.

The following table is provided for convenience in describing the elements of FIG. 1:

1. Downhill start-off building including panorama restaurant
2. Bobsled run
3. Difficult ski slope—world cup level
4. Medium ski slope—skiing and snowboard half pipe
5. Beginner ski slope—sledding, skiing or snowboard
6. Entertainment event area, finish of the ski runs, ice skating rink, reindeer sleigh ride facilities, winter Christmas market
7. Ski and snowboard school—power station, plant room for snow-making equipment, water collection and supply
8. Hotel—Casino—Shopping Mall
9. Swiss mountain village—winter wildlife park—cross-country and walking paths—theme areas
10. and 11. Parking lots for cars, buses and helicopters
12. Access roads
13. Administration building As shown in FIG. 1, the winter recreational facility basically comprises a plurality of covered areas interconnected to one another, where the facility will normally be located on a sloping terrain. As mentioned, the facility can be located in very moderate or even arid climates, which enhances the amusement and educational value due to the fact that the participants or visitors will normally be completely unaccustomed to winter sport activities.

The hotel, shopping and administrative buildings 7, 8 and 13 will be made with construction techniques common to arid climates. The roof structures may be rounded or dome-shaped so as to facilitate solar energy utilization. The buildings however need not generally be of rounded structure, but can be adapted to traditional constructions, which may more easily satisfy local building codes. In addition, as mentioned, the solar energy collecting panels can also be alternatively or additionally provided over the parking lot area.

The tunnel-like structures 3, 4 and 5 as well as the event areas 6 and 9 will be constructed of light-weight, but highly heat insulating materials having sufficient strength and durability to withstand the local weather conditions. Great emphasis is placed on the high heat insulation, due to the fact that the interior of the tunnel areas 3, 4 and 5 will normally be kept at temperatures below 0° C. (32° F.) in order to minimize snow loss. One measure to increase heat insulation is the use of coating materials that can be provided on the outside skin surface of the tunnels to block high intensity solar radiation.

Melting snow is collected in a water collection system as part of the power station 7 and is reused to generate new snow. Snow blowing machines of conventional type 15 (shown hidden and schematically in FIG. 1) can be used at selected locations along the ski slopes 3, 4 and 5 as well as in the Swiss mountain village and winter parks 9. In this manner, the water consumption for snow and ice generation is operated in a closed circulation system. Once the facility is in operation, the water consumption for snow and ice itself is reduced to an absolute minimum.

Figure 2:
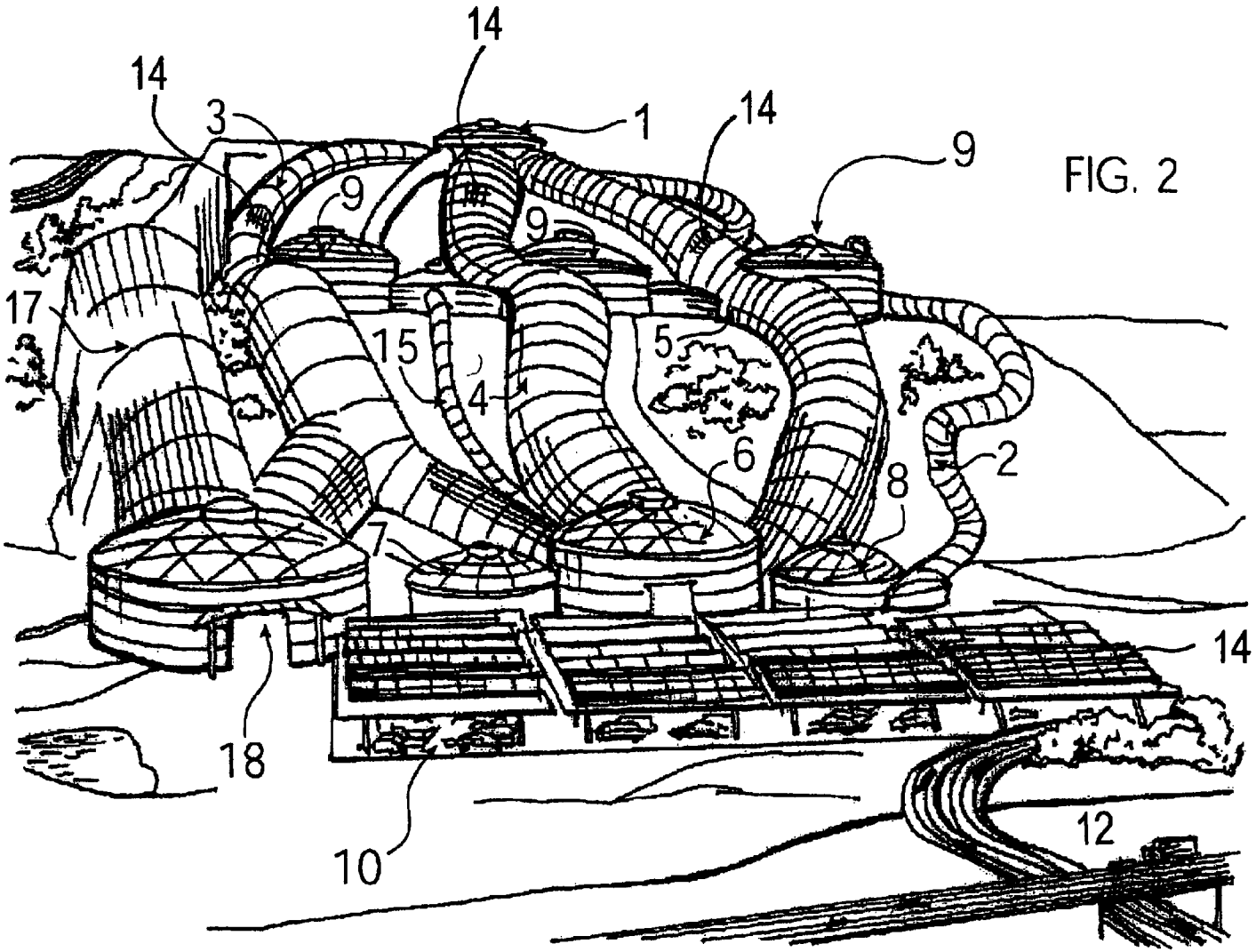
FIG. 2 shows another embodiment of the recreational facility with a ski jump.

Electric power generation is basically provided by the provision of photovoltaic cells 14 on the tunnel-Like structures 3, 4 and 5 and/or covering of the parking lot (see FIG. 2). Only peak power demands need be covered by the local power grid or by own generators.

As mentioned, these tunnel-like structures 3, 4 and 5 can span a width of up to 100 meters and have a length of up to 1 kilometer. The total covered area of the facility is about 75,000 square meters. In addition, when the rounded tunnels are placed in a north-south orientation, a continual tracking of the sun across the sky is achieved to optimize solar energy utilization. In addition, parts of the panels, whether on the tunnels or on the parking roof, can be mechanically guided to follow the sun when desired.

Being located in dry or arid climates, the required capacity for heating is quite low, whereas the cooling demand is high. The main electric power consumers are ice and snow generators as well as ski lifts, cable cars, trains or elevators to transport the participants to the elevated start-off building 1. In the embodiments of FIGS. 1 and 2, ski lifts and cable lifts are located in the tunnel structures 3, 4 and 5 to transport people to the take-off station 1. In the embodiment of FIG. 2, an additional train, for example a cog-wheel train as frequently used in the Swiss Alps, is provided to enhance the theme experience of a mountain setting.

To create snow, conventional snow blowers can be employed where water is pressurized, expanded through an atomizing nozzle and blown to create snow. This method is chosen particularly in the areas 9 to simulate snow falling in a forest or a small mountain village. One of the areas 9 can also be created as a winter wildlife park with mountain deer, rabbits, fox, etc. In these areas the effect of snow falling on the forest and a small Swiss or Alpine village is created, which is especially educational for children and of interest to visitors coming from dry and arid regions.

Another aspect of the area 9 can be the creation of an "ice city" constructed largely of ice structures, where hotels, shops, cafes and parks are provided. The atmosphere of winter in cities of northern latitude can be re-created, including Christmas markets, building a snowman, throwing snowballs, creating ice sculptures, etc. In addition, the areas 9 are generally on the same level and can be interconnected by passageways as illustrated in the embodiment of FIG. 2. This allows the visitor more flexibility and convenience in experiencing different themes.

The ski slopes, sledding and snowboard slopes themselves are preferably supplied with snow using more environmental-friendly means. Water can be sprayed on concrete walls, which are kept below freezing, for example with an ammonia-based coolant. Ice and frost forming on the surface of the concrete walls is scraped off and transported to the ski slopes by snowplows or snowmobiles. The underlying surface of the ski slopes are preferably cooled, for example by an underground piping system in which a coolant is circulated.

A particularly advantageous and attractive feature of the embodiment of FIG. 2 is the provision of a ski jump 17, which fulfills the standards of international regulating authorities for ski jumping. The ski jump facility 17 connects at the lower landing area to an arena 18 with a capacity of at least 15,000 spectators. The ski jump can be employed for "indoor" ski jumping competitions as well as for training areas for ski jumpers in the off season. In a particular embodiment, the ski jump is adjustable at least partly in its length, for example at lower table from which the ski jumper leaves the ramp. Furthermore, the angle of the table is adjustable, which greatly facilitates training sessions by the ability to alter the difficulty of the ski jump.

It is contemplated that the upper portion of the ski jump is also adjustable in angle. As opposed to conventional ski jumps in Europe built solidly into mountain sides, the present ski jump can be built as a movable structure whose length and angle are adjustable according to the given needs. High difficulty situations can be adjusted for competitions, whereas for training, any level of ski jumping can be achieved. Moreover, the length and angle of the ski jump can be adjusted to simulate any of the well-known ski jumps in Europe and North America which are used in international competition.

In another aspect of the embodiment of FIG. 2, the bobsled run is designed to meet the standards of international competition and can be used for a new possibility of "indoor" bobsled competitions. Alternatively, in a further embodiment, a system of rails or tracks are provided in the bob tunnel which can be used for "amateur" bobbing. In other words, special sleds running on tracks can be employed for entertainment purposes of the visitors (amateurs), which ensure a safe but exhilarating bobsled run. When holding competitions or in training sessions for professional bobsledders, the tracks can be retracted and/or embedded in ice, so as to provide competition bob conditions.

Figure 3:
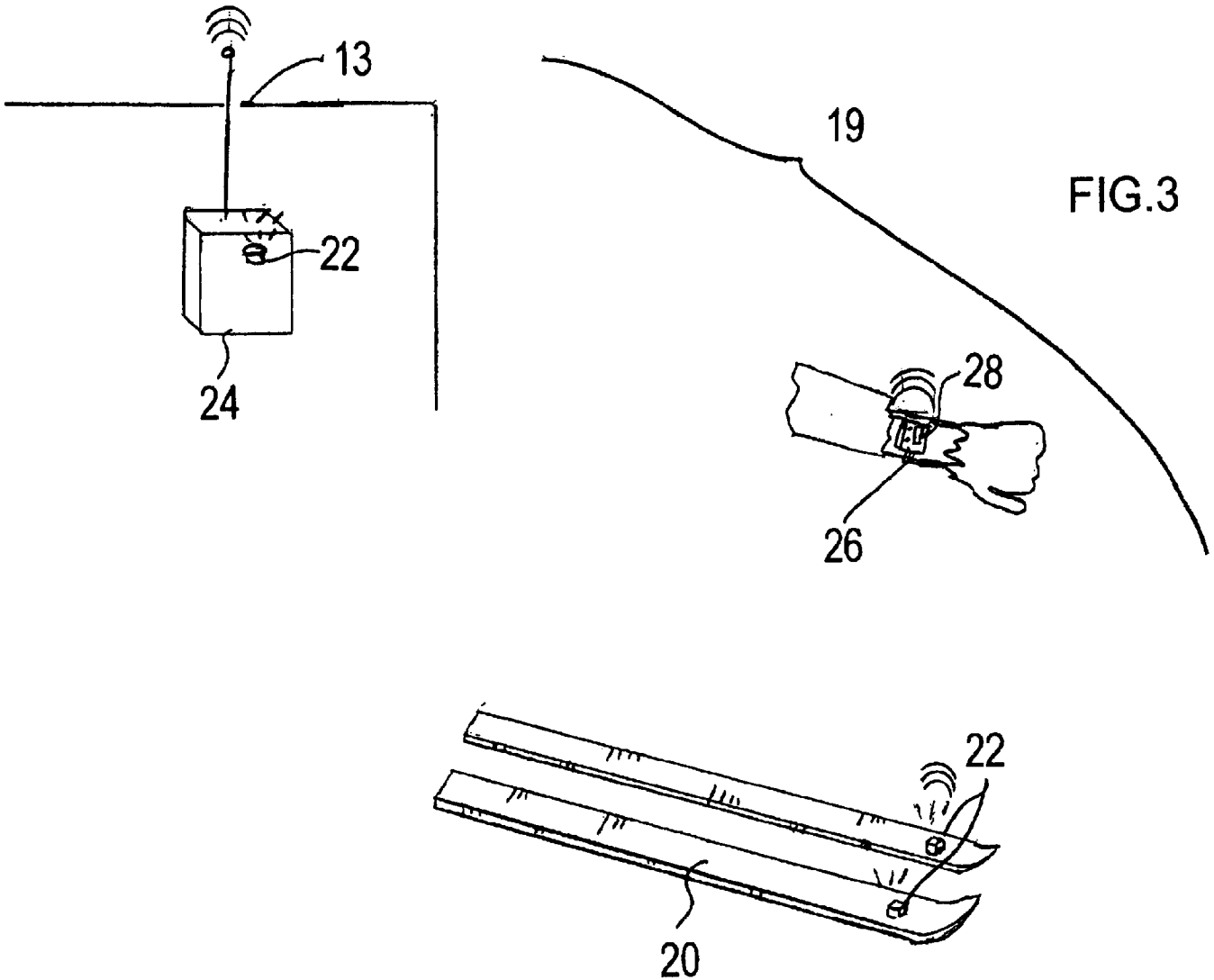
FIG. 3 is a schematic representation of an interactive system suitable for use with the present recreational facility.

In a particularly advantageous embodiment, and referring now to FIG. 3. an interactive aspect is added to the amusement effect. As mentioned above, the winter facilities can include ski slopes, ski jumps, sledding runs, snowboard halfpipes, bobsled runs, snowmobile runs, ice skating rinks, curling rinks, hockey rinks and the like. In a preferred system, generally designated 19, the active devices 20 used by the participants include downhill skis, snowboards, sleds, bobsleds, snowmobiles, ice skates, hockey gear, curling gear, etc. Sensors 22 are provided not only on the active devices 20, but also in the respective facility in order to monitor the activities of the individual participants. The information is collected in a central information processing system 24, which has the capability of informing the individual participant of his current activity. For this purpose, each participant is provided with a wireless or radio receiving device 26 with a display 28, for example attached to his or her wrist. In this way, he or she can receive information not only on his activities, but also other types of information.

In the interactive aspect of the invention, the performance or activity of one participant may lead to advantages or surprises to another participant. For example when a near record high speed is reached on a bobsled run, this can lead to a prize for the bobsled riders or free run for all of those other participants currently holding bobsled tickets. The speed of the run can be detected by sensors on the bobsled, the information passed to the information processing system and the free tickets awarded to the other participants through communication through their wireless receiving devices.

In another example, an exceptional ski jump by a 14-year old on the ski jumping facility can be detected by monitors on the ski, which can lead to an additional 3 free jumps for that particular participant. It can also lead to free jumps for all other participants under the age of 14 as a bonus for the younger participants. Alternatively, the participant can be rewarded a prize for his performance.

The interactive aspect can also transfer from one facility to another. Should for example it be detected that there are too many participants in the snowboard halfpipe, i.e. the capacity of the halfpipe is being reached, this can be detected again by sensors on the snowboards. In this case, the snowboarders can be informed via their wireless receivers, for example in the form of a watch-like display, that they have been awarded free access to the hockey rink including skates for 1 hour.

As will be recognized, many possibilities of participants receiving bonuses, prizes or awards exist, thereby greatly adding to the overall entertainment effect. In another example, should the ski sensors determine that a certain skier has repeatedly fallen over a given period (e.g. ½ hour), such a person may be informed over the wireless receiver that a pause may be advisable and that they are invited to a free beverage at the nearest cafe or restaurant.

While a particular embodiment of the present interactive winter recreation facility has been described herein, it will be appreciated by those skilled in the art that changes and modifications may be made thereto without departing from the invention in its broader aspects and as set forth in the following claims.

What is claimed is:

1. A winter recreational park for amusing and entertaining one or more participants comprising:

a plurality of interconnected housing structures each adapted to safely house the participants and at least one winter facility based on the media of artificial snow and/or ice, a plurality of active devices adapted to the respective winter facility to create a desired effect when used on said snow and/or ice, and means for interactively coupling the one or more participants engaging in at least one of said active devices, wherein the result of use of at least one of said active devices by the one or more participants in said at least one winter facility is interactively coupled to the activity of one or more other participants using the same or another active device in the same or another said at least one winter facility.

2. The winter recreational park of claim 1, wherein the winter facilities are selected from the group consisting of ski slopes, ski jumps, sledding runs, snowboard halfpipes, bobsled runs, snowmobile runs, ice skating rinks, curling rinks, hockey rinks and the like.

3. The winter recreational park of claim 1, wherein the winter facilities further include a winter wildlife park, a city constructed predominantly of ice or a Swiss alpine village.

4. The winter recreational park of claim 1, wherein one of the winter facilities comprises a covered bobsled run located in a tubular structure.

5. The winter recreational park of claim 4, wherein the floor of the bobsled run is provided with tracks, which can be exposed to carry bobsleds with wheels for amusement runs and which can be covered with ice to carry normal bobsleds with blades for professional use.

6. The winter recreational park of claim 1, wherein the active devices include skis, snowboards, sleds, bobsleds, snowmobiles, ice skates, hockey equipment, curling gear or the like.

7. The winter recreational park of claim 1, wherein an outside surface of the housing structures is formed of lightweight translucent construction material with a coating for reflecting UV radiation.

8. The winter recreational park of claim 7, wherein the outside surface of the housing structures is at least partially covered with solar cells for electricity generation.

9. The winter recreational park of claim 1, wherein the housing structures are formed as domes or tunnels for housing the winter facilities.

10. The winter recreational park of claim 1, wherein snow and/or ice generators are provided in one or more of the housing structures, the generators being powered with electricity from a solar cell assembly.

11. The winter recreational park of claim 10, wherein the solar cell assembly is integrated into the roof structure of a parking lot for visitors.

12. The winter recreational park of claim 1, wherein said means for interactively coupling the participants include a central information processing system communicating with at least one sensor located on at least one of said active devices used by at least one of the participants.

13. The winter recreational park of claim 12, further including at least one receiving device in communication with said central processing system for providing information to the at least one participant at least partially based on information generated by said sensors.

14. The winter recreational park of claim 13, wherein said at least one receiving device is one of wireless or radio controlled and includes a display.

* * * * *